US008159902B2

(12) United States Patent
Kim et al.

(10) Patent No.: US 8,159,902 B2
(45) Date of Patent: Apr. 17, 2012

(54) APPARATUS AND METHOD FOR LOCALIZING SOUND SOURCE IN ROBOT

(75) Inventors: Hyun-Soo Kim, Yongin-si (KR); Dong-Suk Yook, Seoul (KR); Young-Kyu Cho, Seoul (KR); Woo-Jin Choi, Seoul (KR)

(73) Assignees: Samsung Electronics Co., Ltd (KR); Korea University Research and Business Foundation (KR)

( * ) Notice: Subject to any disclaimer, the term of this patent is extended or adjusted under 35 U.S.C. 154(b) by 421 days.

(21) Appl. No.: 12/436,434

(22) Filed: May 6, 2009

(65) Prior Publication Data

US 2009/0279714 A1 Nov. 12, 2009

(30) Foreign Application Priority Data

May 6, 2008 (KR) ..... 10-2008-0041786

(51) Int. Cl.
*H04R 3/00* (2006.01)

(52) U.S. Cl. ..... 367/127; 901/1

(58) Field of Classification Search ..... 367/127; 901/1

See application file for complete search history.

(56) References Cited

U.S. PATENT DOCUMENTS 5,930,202 A * 7/1999 Duckworth et al. ..... 367/127
6,178,141 B1 * 1/2001 Duckworth et al. ..... 367/127
2005/0249038 A1 * 11/2005 Rui et al. ..... 367/124
2006/0098533 A1 * 5/2006 Hickling ..... 367/87
2008/0181430 A1 * 7/2008 Zhang et al. ..... 381/92
2009/0279714 A1 * 11/2009 Kim et al. ..... 381/92

OTHER PUBLICATIONS

Johansson et al.: "Acoustic Direction of Arrival Estimation, A Comparison Between Root-Music and SRP-PHAT", IEEE Region 10 Conference on Computer, Communications, Control and Power Engineering, 2004.
Brandstein et al: "A Closed-Form Location Estimator for use with Room Environment Microphone Arrays", IEEE Transactions on Speech and Audio Processing, 1997.
Benesty: "Adaptive Eigenvalue Decomposition Algorithm for Passive Acoustic Source Localization", The Journal of the Acoustical Society of America, 2000.
DiBiase: "A High-Accuracy, Low-Latency Technique for Talker Localization in Reverberant Environments Using Microphone Arrays", PhD Thesis, Brown University, 2000.
Knapp et al.: "The Generalized Correlation Method for Estimation of Time Delay", IEEE Transactions on Acoustics, Speech, and Signal Processing, 1976.
Omologo et al.: "Use of the Crosspower-Spectrum Phase in Acoustic Event Location", IEEE Transactions on Speech and Audio Processing, 1997.

* cited by examiner

*Primary Examiner* — Daniel Pihulic
(74) *Attorney, Agent, or Firm* — The Farrell Law, P.C.

(57) ABSTRACT

An apparatus and method for localizing a sound source in a robot are provided. The apparatus includes a microphone unit implemented by one or more microphones, which picks up a sound from a three-dimensional space. The apparatus also includes a sound source localizer for determining a position of the sound source in accordance with Time-Difference of Arrivals (TDOAs) and a highest power of the sound picked up by the microphone unit. Thus, the robot can rapidly and accurately localize the sound source in the three-dimensional space with minimum dead space, using a minimum number of microphones.

15 Claims, 8 Drawing Sheets

APPARATUS AND METHOD FOR LOCALIZING SOUND SOURCE IN ROBOT

PRIORITY

This application claims priority under 35 U.S.C. §119(a) to an application entitled "APPARATUS AND METHOD FOR LOCALIZING SOUND SOURCE IN ROBOT" filed in the Korean Intellectual Property Office on May 6, 2008 and assigned Serial No. 2008-0041786, the contents of which are incorporated herein by reference.

BACKGROUND OF THE INVENTION

1. Field of the Invention

The present invention relates generally to an apparatus and method for localizing a sound source in a robot, and more particularly, to an apparatus and method for enabling a miniaturized robot to rapidly and exactly localize a sound source in three-dimensional space with minimum dead space and using a minimum number of microphones.

2. Description of the Related Art

Utility robots that act as partners to human beings and assist in daily life, including various human activities outside of the home, are currently being developed. Unlike industrial robots, utility robots are built like human beings, move like human beings in human living environments, and thus are referred to as humanoid robots (herein referred to as "robots").

In general, a robot walks with two legs (or moves using two wheels) and has a plurality of joints and drive motors, which drive the joints, to move its hands, arms, neck, legs, etc., like human beings. For example, 41 joint drive motors are installed in Hubo, a humanoid robot developed by Korea Advanced Institute of Science and Technology (KAIST) in December 2004, and drive respective joints.

Drive motors of a robot are generally separately controlled. To control the drive motors, a plurality of motor drivers, each of which control at least one of the drive motors, are installed in the robot and controlled by a control computer installed inside or outside of the robot.

As robots are developed to be more humanlike, technology has also been developed that enables users to communicate with the robots, for example, to issue verbal orders.

If a robot looks away from a user while the user is communicating with the robot, the user may not feel satisfied with the communication. Thus, the robot needs to localize the user, i.e., the sound source, in order to look in the direction of the user.

In general, sound source localization methods are classified into the following types:

1) Methods of localizing a sound source by maximizing steered power of a beamformer, 2) Methods of localizing a sound source on the basis of high-resolution spectrum estimation, and 3) Methods of localizing a sound source using difference in sound arrival times at a plurality of sensors, i.e., Time-Difference Of Arrivals (TDOAs) between sensors.

A representative method of localizing a sound source by maximizing steered power of a beamformer is a Steered Response Power (SRP) algorithm, which is described in detail in "A High-Accuracy, Low-Latency Technique for Talker Localization in Reverberant Environments Using Microphone Arrays" written by J. Dibiase and published in 2000.

A representative method of localizing a sound source on the basis of high-resolution spectrum estimation is a Multiple Signal Classification (MUSIC) algorithm, which is described in detail in "Adaptive Eigenvalue Decomposition Algorithm for Passive Acoustic Source Localization" written by J. Benesty and published in 2000.

A representative method of localizing a sound source using TDOAs between sensors is a Generalized Cross-Correlation (GCC) algorithm, which is described in detail in "The Generalized Correlation Method for Estimation of Time Delay" written by C. H. Knapp and G. C. Carter and published in 1976.

As one of the various algorithms for localizing a sound source, a GCC-Phase Transform (PHAT) algorithm, which is a GCC algorithm employing a PHAT filter, involves a relatively small amount of computation, and making it is possible to localize a sound source in real time. An SRP-PHAT algorithm, which is an SRP algorithm employing a PHAT filter, is a grid search method of dividing a whole space into blocks and localizing a sound source in each block. However, the SRP-PHAT algorithm involves a large amount of computation. Thus, the SRP-PHAT algorithm is difficult to use in real time but has better sound source localization performance than the GCC-PHAT algorithm.

The PHAT filter is described in detail in "Use of The Crosspower-Spectrum Phase in Acoustic Event Location" written by M. Omologo and P. Svaizer and published in 1997.

FIG. 1 illustrates a microphone array for localizing a sound source in three-dimensional space using the GCC-PHAT algorithm. As illustrated in FIG. 1, to localize a sound source in a three-dimensional space using the GCC-PHAT algorithm, at least eight microphones 10 must be arranged in the form of a cube, that is, at the corners of the cube.

More specifically, to localize a sound source in a three-dimensional space using the GCC-PHAT algorithm, the position of the sound source must be searched for in all directions (up, down, forward, backward, left and right) from the robot. Thus, the sound source is localized using TDOAs between the microphones 10 diagonally disposed in each square surface of the cube.

In a method of localizing a sound source in a three-dimensional space using the SRP-PHAT algorithm, the positions of the microphones 10 are unlimited.

As mentioned above, the SRP-PHAT algorithm divides the whole space in all directions from the robot into blocks, searches each block for a sound source, and thus involves a larger amount of computation than the GCC-PHAT algorithm. Thus, the SRP-PHAT algorithm is difficult to use to localize a sound source in real time but has excellent sound source localization performance in a three-dimensional space.

The general GCC-PHAT algorithm using the eight microphones 10 as illustrated in FIG. 1 can accurately localize a sound source in a three-dimensional space. However, since eight or more microphones are necessary, it is difficult to use the general GCC-PHAT algorithm in a miniaturized robot, such as a mini robot.

In order to apply the GCC-PHAT algorithm using the minimum number of microphones, four microphones 10 may be disposed in a plane as illustrated in FIG. 2. However, when the four microphones 10 are disposed in a rectangular form, a sound source to the front, back left or right can be localized but a sound source disposed above or below cannot. For a mini robot, this drawback is not a serious problem because of its small height. But the larger the robot and the higher the position of the microphones 10, the greater a dead space in which a sound source cannot be localized.

The method of localizing a sound source using the SRP-PHAT algorithm does not limit the positions of microphones and has better performance than the method using the GCC- PHAT algorithm. But the method using the SRP-PHAT algorithm involves too much computation to process in a real-time system, and thus, it is difficult to apply the method to a miniaturized robot.

The sound source localization method of a miniaturized robot must be able to minimize the number of microphones used, minimize a dead space in sound source direction estimation, and rapidly and accurately localize the sound source in three-dimensional space.

SUMMARY OF THE INVENTION

The present invention has been made to address at least the above problems and/or disadvantages and to provide at least the advantages described below. Accordingly, an aspect of the present invention provides an apparatus and method of a robot for localizing a sound source in three-dimensional space using a minimum number of microphones.

Another aspect of the present invention provides a hybrid sound source localization apparatus and method of a robot rapidly determining the direction of a sound source using a Generalized Cross-Correlation (GCC)-Phase Transform (PHAT) algorithm and accurately localizing the sound source in the sound source direction using a Steered Response Power (SRP)-PHAT algorithm.

An additional aspect of the present invention provides a sound source localization apparatus and method of a robot appropriately disposing and installing a plurality of, e.g., four, microphones for localizing a sound source and minimizing a dead space in which a sound source cannot be localized.

According to one aspect of the present invention an apparatus is provided for localizing a sound source in a robot. The apparatus comprises a microphone unit implemented by one or more microphones, which picks up sound from a three-dimensional space. The apparatus also comprises a sound source localizer for determining a position of the sound source in accordance with Time-Difference Of Arrivals (TDOAs) and a highest power of the sound picked up by the microphone unit.

In the microphone unit, four microphones may be disposed at comers of an imaginary tetrahedron.

The sound source localizer may determine a direction of the sound source using a first algorithm in accordance with the TDOAs between the microphones, and may determine one of three directions from the robot as the direction of the sound source using a GCC-PHAT algorithm in accordance with the TDOAs of respective pairs of the microphones.

The sound source localizer may determine two directions calculated from three pairs of the microphones as the direction of the sound source when the directions calculated in accordance with the TDOAs of the three pairs of the microphones are not the same, and may determine the position of the sound source in the three-dimensional space in the direction of the sound source using a second algorithm when the direction of the sound source is determined.

The sound source localizer may determine as the position of the sound source a point of highest power in the three-dimensional space in the direction of the sound source using an SRP-PHAT algorithm.

The sound source localizer may include a first algorithm processor for determining a direction of the sound source according to the TDOAs between the microphones using a GCC-PHAT algorithm. The sound source localizer may also include a second algorithm processor for determining a point of highest power in the three-dimensional space in the direction of the sound source determined by the first algorithm processor using an SRP-PHAT algorithm. The sound source localizer may further include a sound source position determiner for determining as the position of the sound source three-dimensional coordinates of the point determined by the second algorithm processor to have highest power.

The robot may include a camera for taking an image in a view direction of the robot, a plurality of drive motors for providing driving power to move the robot, and a controller for controlling the drive motors to direct the camera toward the three-dimensional coordinates determined by the sound source position determiner.

According to another aspect of the present invention an apparatus is provided for localizing a sound source in a robot. The apparatus comprises a microphone unit implemented by four microphones disposed at comers of an imaginary tetrahedron and picking up a sound from a three-dimensional space. The apparatus also comprises a sound source localizer for determining a direction of the sound source according to TDOAs of the sound picked up from respective pairs of the four microphones of the microphone unit, and determining as a position of the sound source a point of highest power in the three-dimensional space in the direction of the sound source.

According to a further aspect of the present invention a method of localizing a sound source in a robot is provided. A sound is picked up through four microphones disposed at corners of an imaginary tetrahedron at the robot. The direction of a sound source is determined in accordance with TDOAs of the sound between the four microphones using a first algorithm. The position of the sound source is determined in three-dimensional space in the direction of the sound source using a second algorithm.

Determining the direction of the sound source may include determining whether directions calculated according to the TDOAs between the four microphones using a GCC-PHAT algorithm are the same. When the calculated directions are the same, determining the direction of the sound source may also include determining a direction from among three directions divided according to a position of the robot as the direction of the sound source. When the calculated directions are not the same, determining the direction of the sound source may further include determining two directions calculated according to the TDOAs between the microphones as the direction of the sound source.

Determining the position of the sound source may include determining as the position of the sound source three-dimensional coordinates of a point of highest power in three-dimensional space in the determined one or two directions of the sound source using an SRP-PHAT algorithm.

When the position of the sound source in three-dimensional space is determined, a drive motor may be controlled to direct a view of the robot toward the position of the sound source.

According to an additional aspect of the present invention a method of localizing a sound source in a robot is provided. Sound is picked up, at the robot, through four microphones disposed at corners of an imaginary tetrahedron. It is determined whether directions calculated according to TDOAs between the four microphones using a GCC-PHAT algorithm are the same. When the directions are the same, a direction from among three directions divided according to a position of the robot is determined as a direction of the sound source. Three-dimensional coordinates of a point of highest power in a three-dimensional space in the determined sound source direction is determined as the position of the sound source using an SRP-PHAT algorithm. When the directions calculated according to the TDOAs between the microphones are not the same, two directions calculated according to the TDOAs between the microphones are determined as the direction of the sound source. Three-dimensional coordinates of a point of highest power in the three-dimensional space in the determined sound source directions is determined as the position of the sound source using the SRP-PHAT algorithm.

BRIEF DESCRIPTION OF THE DRAWINGS

The above and other aspects, features and advantages of the present invention will be more apparent from the following detailed description when taken in conjunction with the accompanying drawings, in which.

DETAILED DESCRIPTION OF PREFERRED EMBODIMENTS

Figure 1:
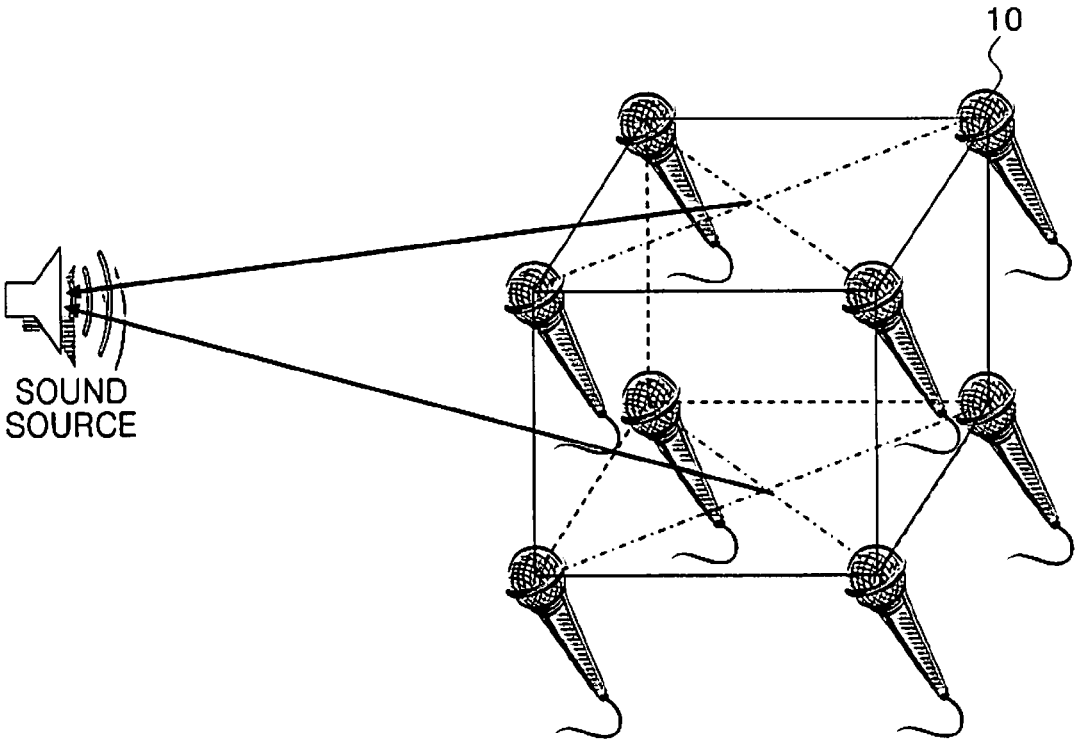
FIG. 1 is a diagram illustrating a microphone array for localizing a sound source in three-dimensional space using a Generalized Cross-Correlation (GCC)-Phase Transform (PHAT) algorithm.

Preferred embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

Figure 3:
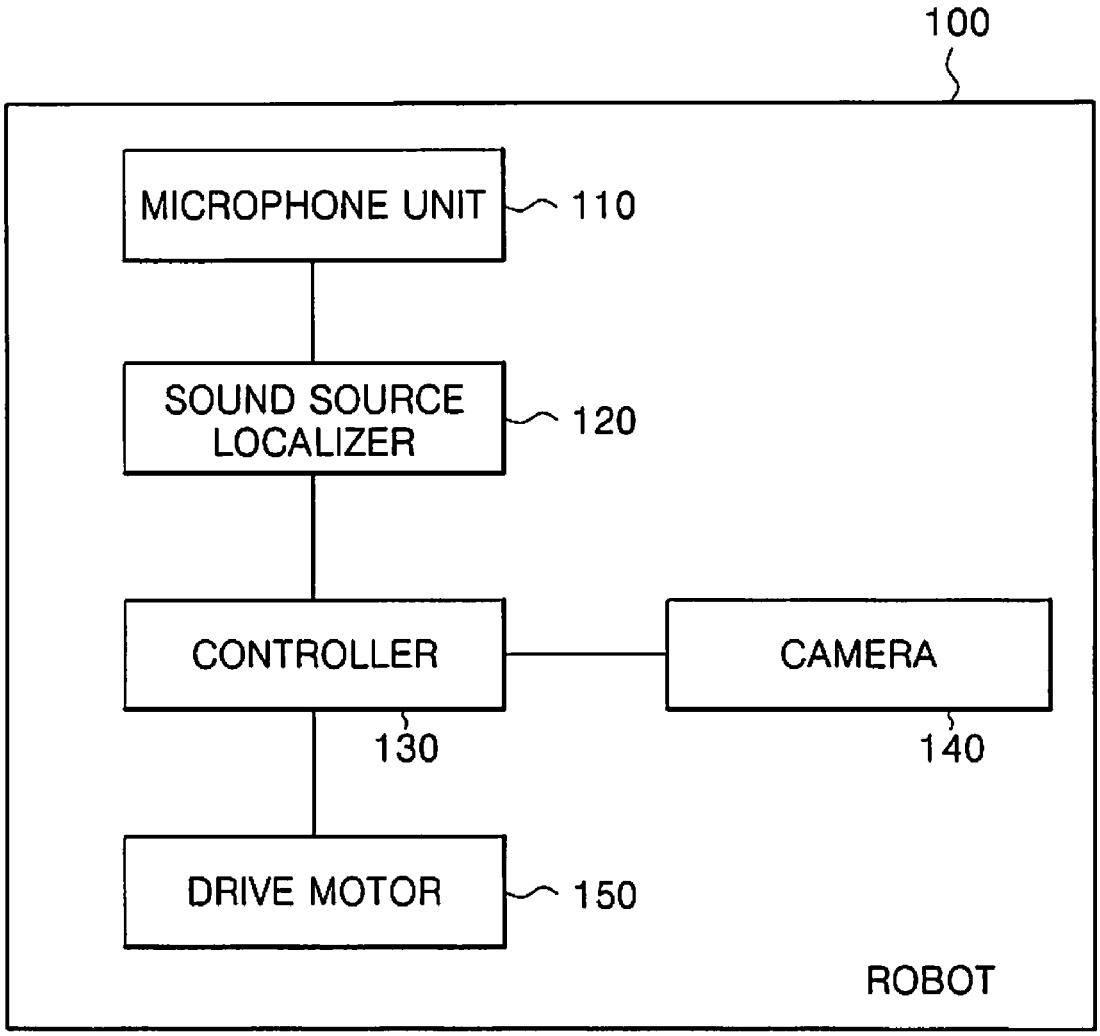
FIG. 3 is a block diagram illustrating an apparatus for localizing a sound source in a robot according to an embodiment of the present invention.

FIG. 3 is a block diagram illustrating an apparatus for localizing a sound source in a robot according to an embodiment of the present invention.

Referring to FIG. 3, a robot 100 according to an embodiment of the present invention includes a microphone unit 110, which is implemented by a plurality of, e.g., four, microphones 111, a sound source localizer 120, which localizes a sound source in three-dimensional space, a camera 140, which takes an image in the view direction of the robot 100, a plurality of drive motors 150, which provide driving power for moving the robot 100 itself and the view direction, hands, etc., of the robot 100, and a controller 130, which controls the drive motors 150 to direct the view of the robot 100 toward the position of the sound source in three-dimensional space, i.e., three-dimensional coordinates localized by the sound source localizer 120.

When the sound source localizer 120 determines the position of a sound source, the controller 130 controls the drive motors 150 to direct the view of the robot 100 toward the position of the sound source, which is presumed to be a user.

The drive motors 150 provide driving power to change joint angles of the robot 100, and the robot 100 moves using the driving power provided by the drive motors 150.

The microphone unit 110 may be implemented by, for example, the four microphones 111 disposed at comers of an imaginary tetrahedron.

Figure 4A:
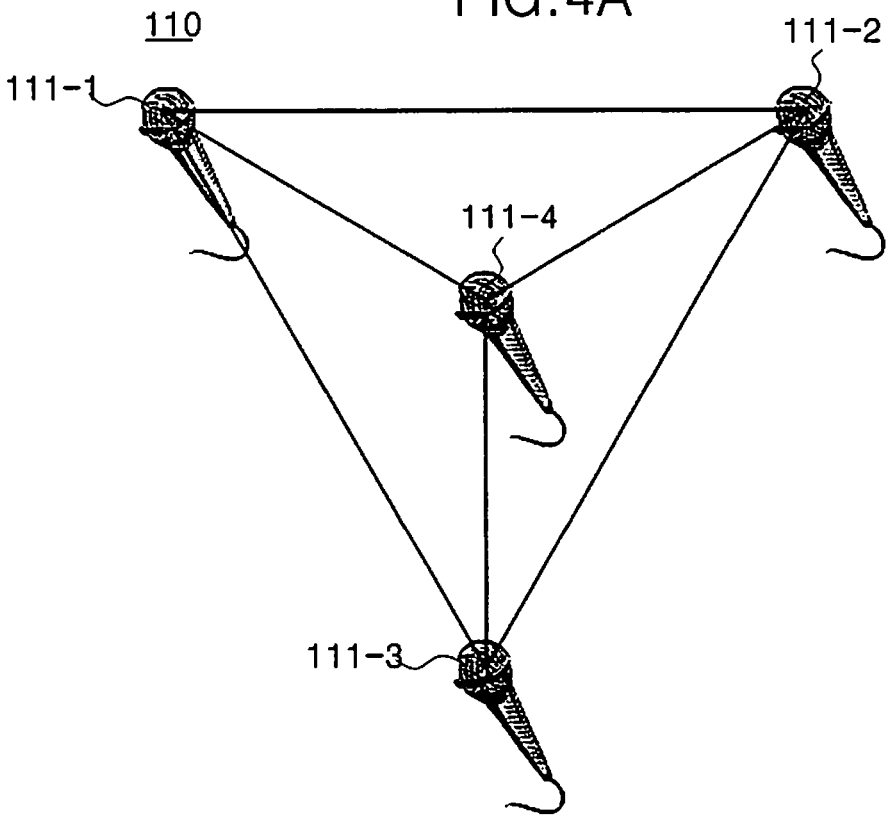
FIGS. 4A and 4B illustrate a microphone array of a microphone unit according to an embodiment of the present invention.
Figure 4B:
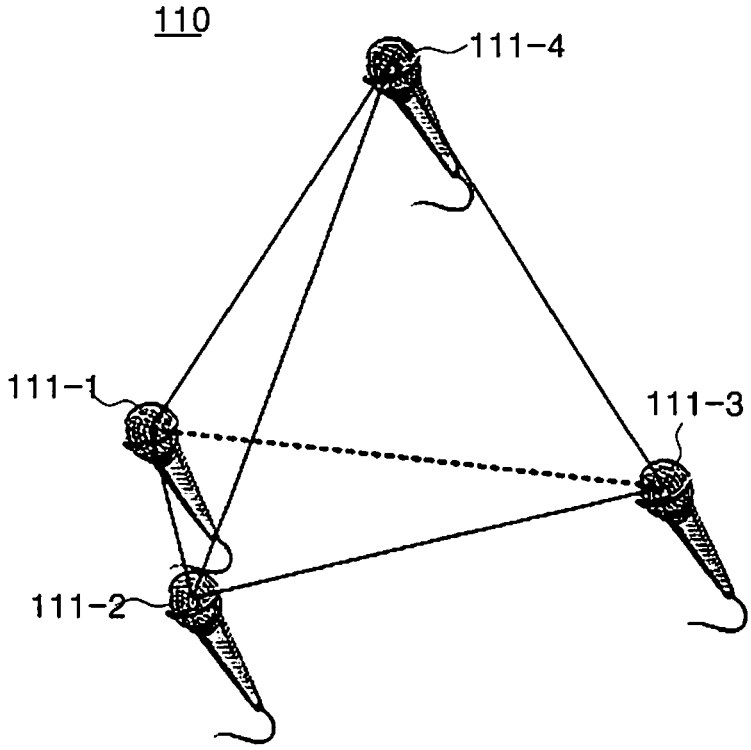

FIGS. 4A and 4B illustrate a microphone array of a microphone unit according to an embodiment of the present invention.

As illustrated in FIGS. 4A and 4B, the microphones 111-1, 111-2, 111-3 and 111-4 of the microphone unit 110, according to an embodiment of the present invention, are disposed at the comers of an imaginary regular tetrahedron, respectively, and neither the distances nor the distance ratios between the microphones 111-1, 111-2, 111-3 and 111-4 are limited.

Figure 2:
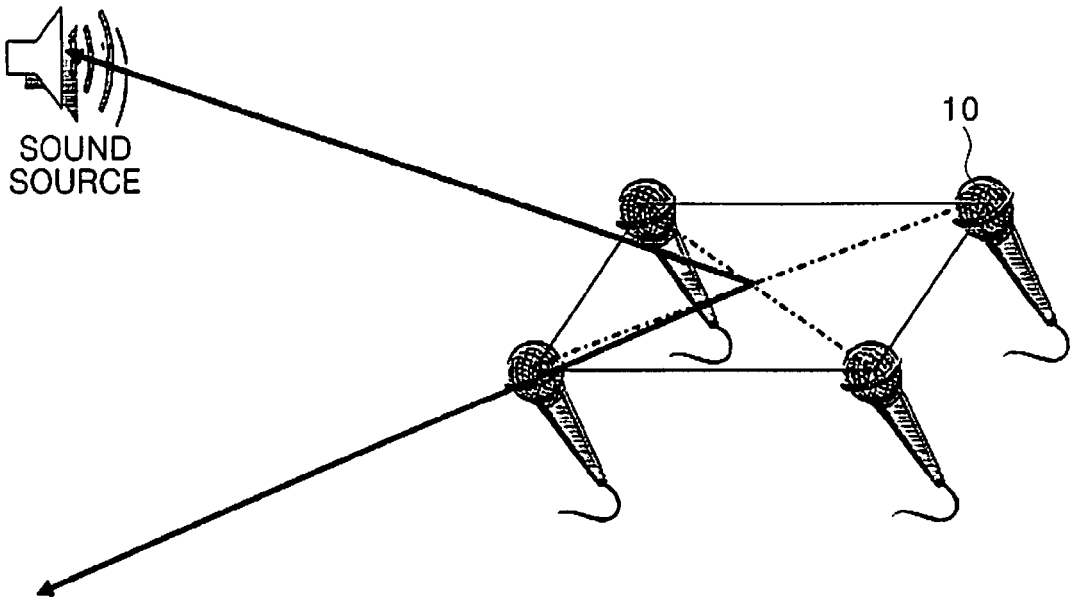
FIG. 2 is a diagram illustrating four microphones disposed in a plane.

When the four microphones 111-1, 111-2, 111-3 and 111-4 are disposed in the form of a regular tetrahedron as illustrated in FIGS. 4A and 4B, there are direct paths from a sound source in three-dimensional space to three or more of the microphones 111-1, 111-2, 111-3 and 111-4 so that the sound source can be localized. In comparison with the rectangular array of the microphones 10 shown in FIG. 2, dead space in which a sound source cannot be localized is remarkably reduced.

Figure 5A:
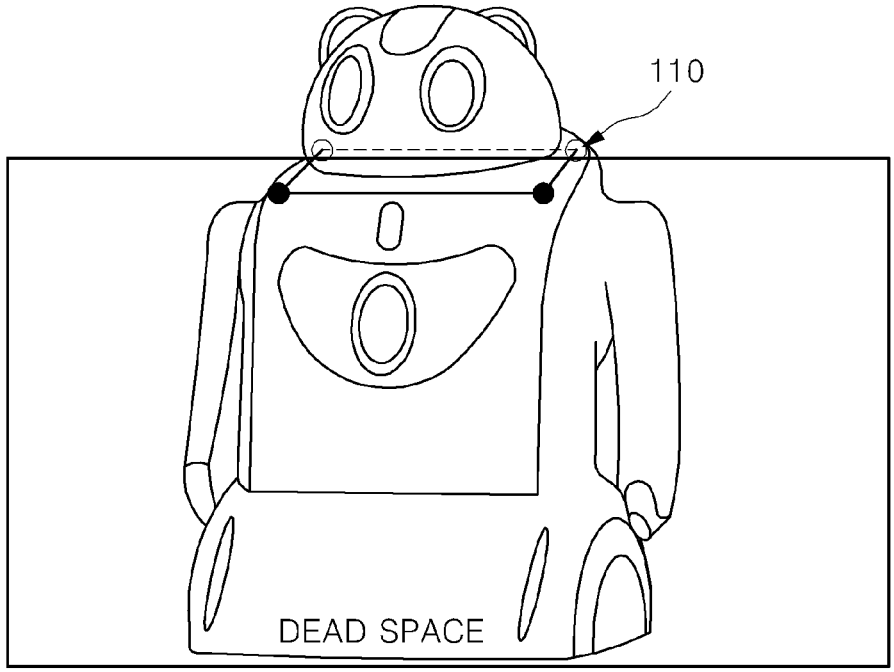
FIGS. 5A and 5B illustrate dead space in which a robot cannot localize a sound source.
Figure 5B:
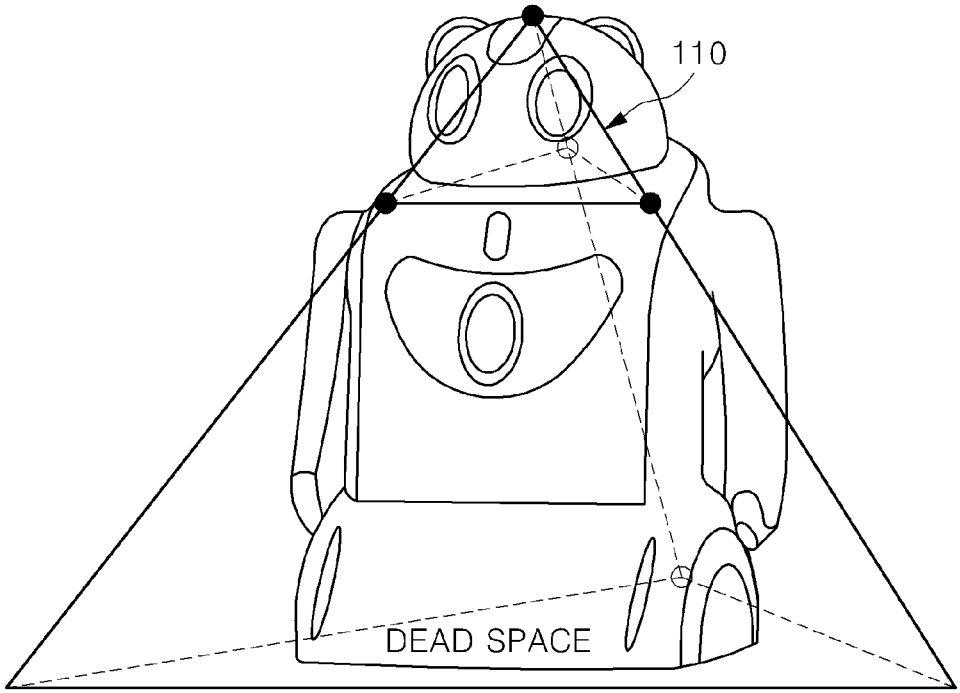

FIGS. 5A and 5B illustrate dead space in which a robot cannot localize a sound source. FIGS. 5A and 5B illustrate example cases in which a microphone unit is implemented in the head of the robot 100.

FIG. 5A illustrates a dead space formed when the four microphones 10 are disposed in a rectangular form, and FIG. 5B illustrates a dead space formed when the four microphones 111-1, 111-2, 111-3 and 111-4 are disposed in the form of a regular tetrahedron. When the four microphones 111-1, 111-2, 111-3 and 111-4 are disposed in the form of a regular tetrahedron, a sound source that is above or below can be localized, and thus dead space is remarkably reduced.

When sound is picked up through the microphone unit 110, the sound source localizer 120 determines the direction of the sound source using a Generalized Cross-Correlation (GCC)-Phase Transform (PHAT) algorithm, and the position of the sound source in three-dimensional space in the determined sound source direction using a Steered Response Power (SRP)-PHAT algorithm.

More specifically, the sound source localizer 120 determines a rough direction of the sound source, i.e., the sound source direction, using the GCC-PHAT algorithm, divides three-dimensional space not in all directions but only toward the sound source from the robot 100 into blocks, and determines the position of the sound source using the SRP-PHAT algorithm.

In addition, the sound source localizer 120 provides the three-dimensional coordinates of the determined sound source position to the controller 130 so that the controller 130 directs the view of the robot 100 toward the sound source position.

Figure 6:
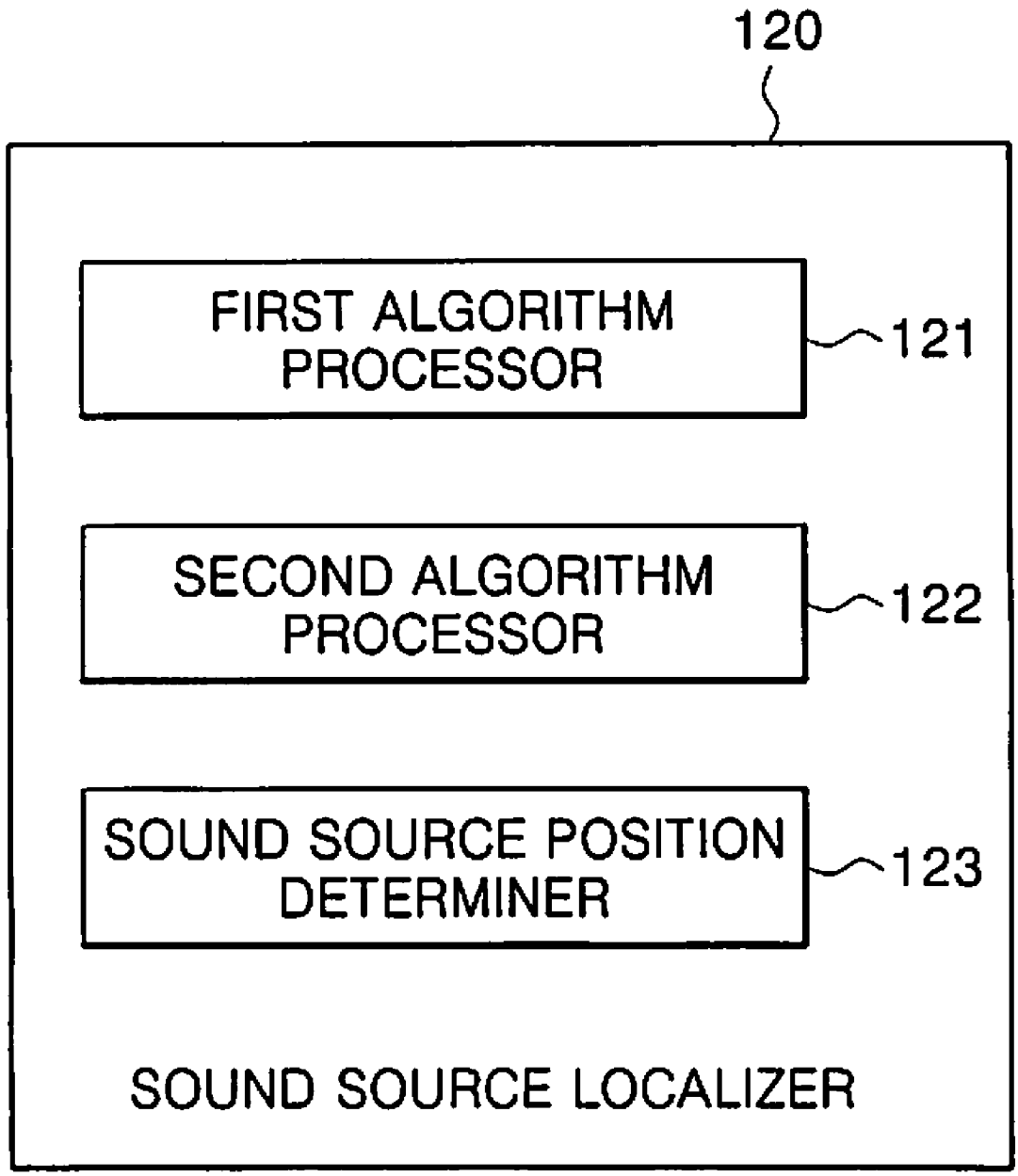
FIG. 6 is a block diagram illustrating a sound source localizer according to an embodiment of the present invention.

FIG. 6 is a block diagram of a sound source localizer according to an embodiment of the present invention.

Referring to FIG. 6, the sound source localizer 120 according to an embodiment of the present invention includes a first algorithm processor 121, a second algorithm processor 122 and a sound source position determiner 123.

When sound is picked up through the microphone unit 110, the first algorithm processor 121 determines a sound source direction using a first algorithm, that is, the GCC-PHAT algorithm on the basis of Time-Difference Of Arrivals (TDOAs) between the microphones 111-1, 111-2, 111-3 and 111-4.

The first algorithm processor 121 may calculate the TDOAs between the microphones 111 using the following Equation (1):

$$R_\{12\}(\tau)=\{1\} \text{ over } \{2\pi\} \text{ int}_\{-\infty\}\hat{}\{+\infty\}\{X_\{1\}(\omega)X_\{2\}\hat{}\{*\}(\omega)\} \text{ over } \{\text{LEFT}|\{X_\{1\}(\omega)X_\{2\}\hat{}\{*\}(\omega)\text{RIGHT}|\}\}d\omega \quad (1)$$

Equation (1) denotes a cross-correlation when a TDOA between two of the microphones 111-1, 111-2, 111-3 and 1114 is $\tau$, and the cross-correlation may be a TDOA of a sound source obtained when $\tau$ is maximized.

A time relationship is converted into a frequency relationship according to a PHAT filter, and the maximum TDOA is calculated.

Then, using the maximum TDOA, a sound source direction is determined by the following Equation (2):

$$\hat{\tau}_{12} = \underset{\tau \varepsilon D}{\operatorname{argmax}} R_{12}(\tau) \quad (2)$$

In Equation (2), D is a variable denoting a possible TDOA according to a physical distance between the two microphones 111-1, 111-2, 111-3 and 111-4. Thus, the distance between the microphones 111-1, 111-2, 111-3 and 111-4 does not need to be limited.

The first algorithm processor 121 determines the sound source direction using Equation (1) and Equation (2).

When the first algorithm processor 121 determines the sound source direction, the second algorithm processor 122 determines a sound source position in three-dimensional space in the sound source direction using a second algorithm, that is, the SRP-PHAT algorithm.

To determine the sound source position, the second algorithm processor 122 divides three-dimensional space into blocks and calculates block-specific powers using the following Equation (3):

$$P(q) = \sum_{l=1}^{N} \sum_{k=1}^{N} \int_{-\infty}^{+\infty} \frac{X_1(\omega)X_k^*(\omega)}{X_1(\omega)X_k^*(\omega)} e^{j(\Delta k - \Delta l)} d\omega \quad (3)$$

$$\hat{q}_s = \underset{q}{\operatorname{argmax}} P(q) \quad (4)$$

Powers of all the blocks in three-dimensional space are calculated by Equation (3) for calculating steered power of a beamformer at a point q, and a point at which the highest power is obtained, as expressed by Equation (4), is determined as the sound source position.

When the first algorithm processor 121 determines the sound source direction and the second algorithm processor 122 determines the sound source position, the sound source position determiner 123 transfers three-dimensional coordinates of the sound source to the controller 130.

A method for the sound source localizer 120 to determine the position of a sound source will be described in detail below.

Figure 7:
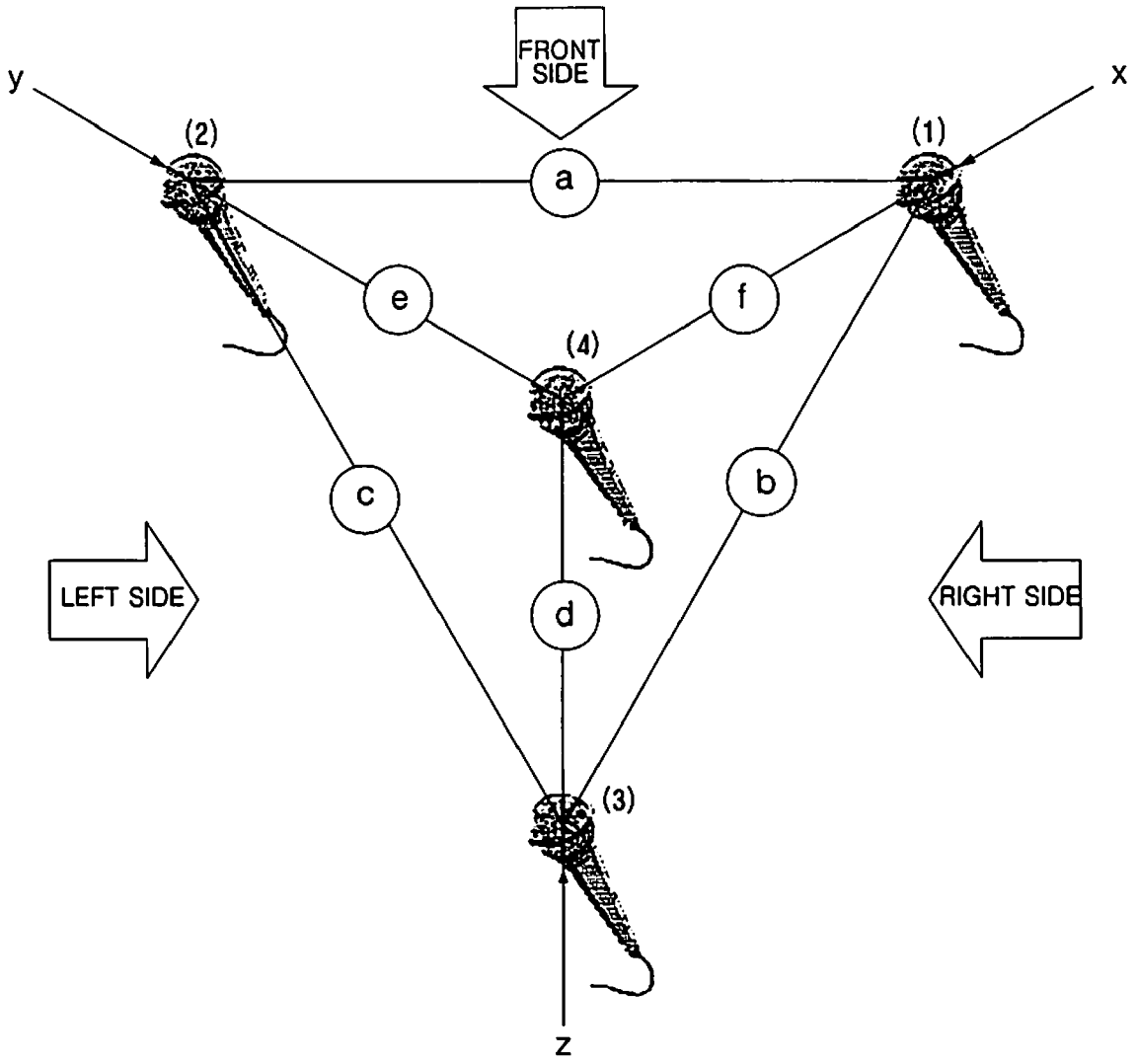
FIG. 7 is a diagram of a microphone array illustrating a method of determining the position of a sound source according to an embodiment of the present invention.

FIG. 7 is a diagram of a microphone array illustrating a method of determining the position of a sound source according to an embodiment of the present invention.

Referring to FIG. 7, when sound is picked up through the microphone unit 110, the first algorithm processor 121 of the sound source localizer 120 calculates TDOAs between the microphones 111-1, 111-2, 111-3 and 111-4 using the GCC-PHAT algorithm and determines the direction of the sound source.

For example, the sound may be generated in front of a regular tetrahedron formed by the microphones 111-1, 111-2, 111-3 and 111-4 of the microphone unit 110. In this case, the sound source directions calculated from microphone pairs a, b and d using the GCC-PHAT algorithm are all forward.

Meanwhile, when sound is generated on the left, all the sound source directions calculated from microphone pairs a, b and f are left, and when sound is generated on the right, all the sound source directions calculated from microphone pairs a, c and e are right.

Thus, the first algorithm processor 121 may determine as the sound source direction one of the three directions, i.e., forward, left and right of the robot 100, on the basis of TDOAs between the microphones 111-1, 111-2, 111-3 and 111-4.

Then, the second algorithm processor 122 determines the position of the sound source in three-dimensional space in the determined sound direction. More specifically, the second algorithm processor 122 executes the SRP-PHAT algorithm using three of the microphones 111-1, 111-2, 111-3 and 111-4 having direct paths to the sound source direction among the four microphones 111-1, 111-2, 111-3 and 111-4 disposed in the form of a regular tetrahedron.

For example, when the sound source direction is determined to be forward, the second algorithm processor 122 localizes the sound source position using (1), (2) and (4) microphones on the basis of the SRP-PHAT algorithm. When the sound source direction is determined to be left, the second algorithm processor 122 localizes the sound source position using (2), (3) and (4) microphones on the basis of the SRP-PHAT algorithm, and when the sound source direction is determined to be right, the second algorithm processor 122 localizes the sound source position using (1), (3) and (4) microphones on the basis of the SRP-PHAT algorithm.

Since the sound source localizer 120 determines the sound source direction using the GCC-PHAT algorithm and determines the sound source position in three-dimensional space in the sound source direction using the SRP-PHAT algorithm, it is possible to have the advantages of both the GCC-PHAT algorithm and the SRP-PHAT algorithm, that is, the ability to determine a sound source direction in real time and the ability to accurately localize a sound source. The sound source localizer 120 can rapidly and accurately determine a sound source position in three-dimensional space.

However, when a sound source is on the x, y or z-axis shown in FIG. 7, the first algorithm processor 121 cannot determine one of the three directions as the sound source direction.

More specifically, when sound is generated on the x-axis, sound source directions calculated from the microphone pairs b and d using the GCC-PHAT algorithm are all forward. However, a TDOA between the microphone pair c is 0, and thus a sound source direction calculated from the microphone pair c is not forward.

In addition, sound source directions calculated from the microphone pairs a and e using the GCC-PHAT algorithm are right, but a sound source direction calculated from the microphone pair c is not right. In other words, all sound source directions calculated from three microphone pairs using the GCC-PHAT algorithm are not the same, and thus any one of the three directions cannot be determined as the sound source direction.

Consequently, when all sound source directions calculated from three microphone pairs using the GCC-PHAT algorithm are not the same, the first algorithm processor 121 determines as the sound source direction two of the three directions calculated from the three microphone pairs, and the second algorithm processor determines the sound source position in three-dimensional space in the two of the three directions using the SRP-PHAT algorithm.

As described above, even if sound source directions calculated from three microphone pairs are not the same, the SRP-PHAT algorithm is executed not on all the directions but on only two of the three directions. Thus, it is possible to determine the position of a sound source faster than a conventional method of determining the position of a sound source using only the SRP-PHAT algorithm.

Figure 8:
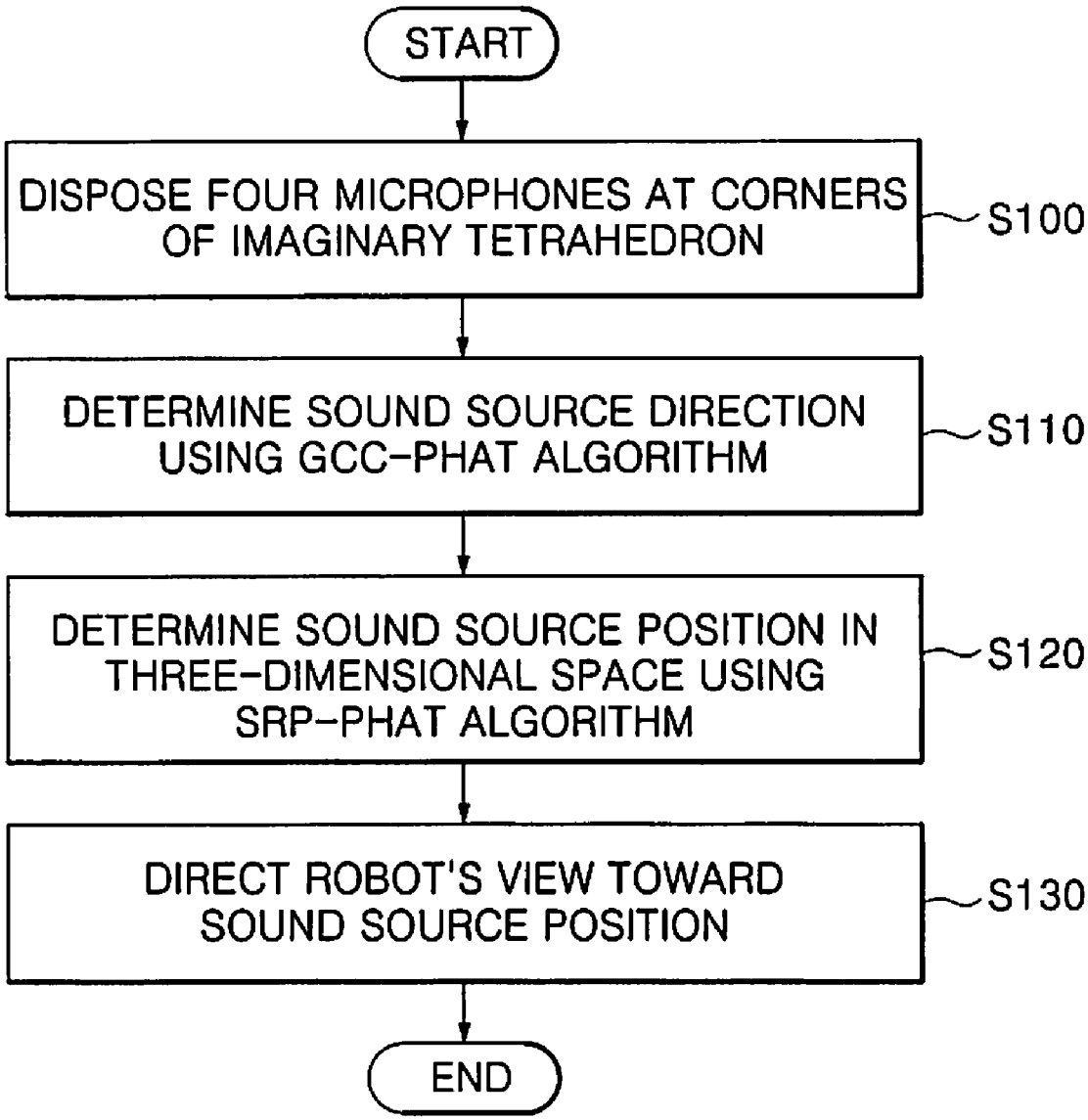
FIG. 8 is a flowchart illustrating a method of localizing a sound source in a robot according to an embodiment of the present invention.

FIG. 8 is a flowchart illustrating a method of localizing a sound source in a robot according to an embodiment of the present invention.

Referring to FIG. 8, a designer or manufacturer of the robot 100 disposes the four microphones 111-1, 111-2, 111-3 and 111-4 constituting the microphone unit 110 at corners of a regular tetrahedron, that is, at corners of an imaginary tetrahedron, in step S100.

When sound is picked up, the robot 100 determines a sound source direction from the robot 100 using a first algorithm, that is, the GCC-PHAT algorithm, in step S110.

When one of the three directions is determined as the sound source direction, the robot 100 determines a sound source position in three-dimensional space using a second algorithm, that is, the SRP-PHAT algorithm, in step S120.

When the sound source position is determined, the robot 100 drives the drive motors 150 to direct its view toward the sound source position in step S130.

Figure 9:
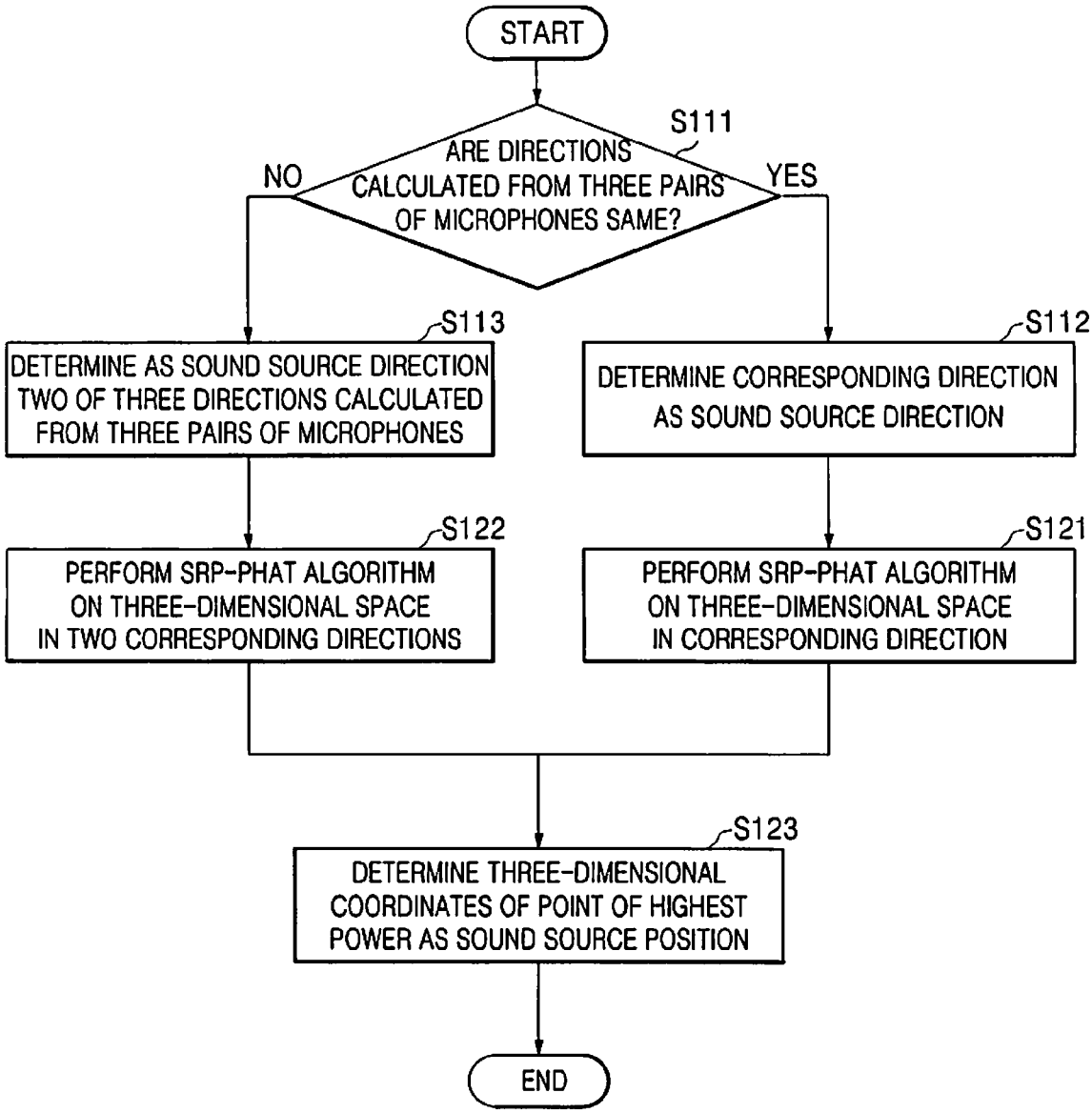
FIG. 9 is a flowchart illustrating a method of determining the direction and position of a sound source in a robot according to an embodiment of the present invention.

FIG. 9 is a flowchart showing a method of determining the direction and position of a sound source in a robot according to an exemplary embodiment of the present invention.

Referring to FIG. 9, when sound is picked up, the robot 100 determines whether or not all sound source directions calculated on the basis of TDOAs between the microphones 111-1, 111-2, 111-3 and 111-4 of three microphone pairs disposed as illustrated in FIG. 7 are the same in step S111.

More specifically, the robot 100 determines whether all sound source directions calculated from the microphone pairs a, b and d, a, b and f, or a, c and e are the same.

When all sound source directions calculated from the three microphone pairs are the same, the robot 100 determines the direction as the sound source direction in step S112.

When all sound source directions calculated from the three microphone pairs are not the same, that is, the sound source exists on the x, y or z-axis, the robot 100 determines as the sound source direction two (forward and left, forward and right, or left and right) of the three directions calculated from the three microphone pairs in step S113.

When one of the three directions is determined as the sound source direction, the robot 100 performs the SRP-PHAT algorithm on three-dimensional space in the direction in step S121.

When two of the three directions are determined as the sound source direction, the robot 100 performs the SRP-PHAT algorithm on three-dimensional space in the two directions in step S122.

The robot 100 determines three-dimensional coordinates of a point of highest power as the sound source position according to the result of the SRP-PHAT algorithm in step S123.

In the above-described embodiments of the present invention, a robot can localize a sound source in three-dimensional space while minimizing dead space using four microphones.

In addition, the robot can rapidly determine the direction of a sound source using the GCC-PHAT algorithm and accurately localize the sound source in the sound source direction using the SRP-PHAT algorithm.

While the present invention has been described with reference to certain preferred embodiments thereof, it will be understood by those skilled in the art that various changes in form and details may be made therein without departing from the spirit and scope of the present invention as defined by the appended claims.

What is claimed is:

1. An apparatus for localizing a sound source in a robot, the apparatus comprising:

a microphone unit comprising a plurality of microphones, wherein the microphone unit picks up a sound from a three-dimensional space; and a sound source localizer for determining a position of the sound source in the three-dimensional space in accordance with Time-Difference Of Arrivals (TDOAs) of the sound between the plurality of microphones and beamforming powers of respective points in the three-dimensional space in a direction of the sound source.

2. The apparatus of claim 1, wherein, in the microphone unit, four microphones are disposed at corners of a tetrahedron.

3. The apparatus of claim 1, wherein the sound source localizer determines the direction of the sound source using a first algorithm in accordance with the TDOAs between the plurality of microphones.

4. The apparatus of claim 3, wherein the sound source localizer determines one of three directions from the robot as the direction of the sound source using a Generalized Cross-Correlation (GCC)-Phase Transform (PHAT) algorithm in accordance with the TDOAs of respective pairs of the plurality of microphones.

5. The apparatus of claim 3, wherein, when directions calculated in accordance with the TDOAs of three pairs of the plurality of microphones are not the same, the sound source localizer determines two directions calculated from the three pairs of the one or more microphones as the direction of the sound source.

6. The apparatus of claim 3, wherein, when the direction of the sound source is determined, the sound source localizer determines the position of the sound source in the three-dimensional space in the direction of the sound source using a second algorithm.

7. The apparatus of claim 6, wherein the sound source localizer determines as the position of the sound source a point of highest power in the three-dimensional space in the direction of the sound source using a Steered Response Power (SRP)-Phase Transform (PHAT) algorithm.

8. The apparatus of claim 1, wherein the sound source localizer comprises:

a first algorithm processor for determining the direction of the sound source according to the TDOAs between the plurality microphones using a Generalized Cross-Correlation (GCC)-Phase Transform (PHAT) algorithm;

a second algorithm processor for determining a point of highest power in the three-dimensional space from the beamforming powers in the direction of the sound source determined by the first algorithm processor using a Steered Response Power (SRP)-PHAT algorithm; and a sound source position determiner for determining, as the position of the sound source, three-dimensional coordinates of the point of highest power determined by the second algorithm processor.

9. The apparatus of claim 8, wherein the robot comprises:

a camera for taking an image in a view direction of the robot;

a plurality of drive motors for providing driving power to move the robot; and a controller for controlling the drive motors to direct the camera toward the three-dimensional coordinates determined by the sound source position determiner.

10. An apparatus for localizing a sound source in a robot, the apparatus comprising:

a microphone unit comprising four microphones disposed at corners of a tetrahedron, wherein the microphone unit picks up a sound from a three-dimensional space; and a sound source localizer for determining a direction of the sound source according to Time-Difference Of Arrivals (TDOAs) of the sound picked up from respective pairs of the four microphones of the microphone unit, and determining as a position of the sound source a point of highest power in the three-dimensional space from beamforming powers of respective points in the three-dimensional space in the direction of the sound source.

11. A method of localizing a sound source in a robot, comprising:

picking up, at the robot, a sound through four microphones disposed at corners of a tetrahedron;

determining a direction of the sound source in accordance with Time-Difference Of Arrivals (TDOAs) of the sound between the four microphones using a first algorithm; and determining a position of the sound source in a three-dimensional space from beamforming powers of respective points in the three-dimensional space in the direction of the sound source using a second algorithm.

12. The method of claim 11, wherein determining the direction of the sound source comprises:

determining whether directions calculated according to the TDOAs between the four microphones using a Generalized Cross-Correlation (GCC)-Phase Transform (PHAT) algorithm are the same;

when the calculated directions are the same, determining a direction from among three directions divided according to a position of the robot as the direction of the sound source; and when the calculated directions are not the same, determining two directions calculated according to the TDOAs between the four microphones as the direction of the sound source.

13. The method of claim 12, wherein determining the position of the sound source comprises:

determining as the position of the sound source three-dimensional coordinates of a point of highest power in the three-dimensional space from the beamforming powers in the determined one or two directions of the sound source using a Steered Response Power (SRP)-PHAT algorithm.

14. The method of claim 11, further comprising:

when the position of the sound source in the three-dimensional space is determined, controlling a drive motor to direct a view of the robot toward the position of the sound source.

15. A method of localizing a sound source in a robot, comprising:

picking up, at the robot, a sound through four microphones disposed at corners of a tetrahedron;

determining whether directions calculated according to Time-Difference Of Arrivals (TDOAs) between the four microphones using a Generalized Cross-Correlation (GCC)-Phase Transform (PHAT) algorithm are the same;

when the directions are the same, determining a direction among three directions divided according to a position of the robot as the direction of the sound source;

when the directions calculated according to the TDOAs between the four microphones are not the same, determining two directions calculated according to the TDOAs between the four microphones as the direction of the sound source; and determining, as the position of the sound source, three-dimensional coordinates of a point of highest power in a three-dimensional space from beamforming powers of respective points in the three-dimensional space in the one or more determined sound source directions using the SRP-PHAT algorithm.

* * * * *